United States Patent [19]

Frankel

[11] Patent Number: 4,458,684

[45] Date of Patent: Jul. 10, 1984

[54] ATHLETIC SUPPORT BRASSIERE

[76] Inventor: Dorothy Frankel, 305 E. 24th St., New York, N.Y. 10010

[21] Appl. No.: 344,645

[22] Filed: Feb. 1, 1982

[51] Int. Cl.[3] ..... A41C 1/14

[52] U.S. Cl. ..... 128/477

[58] Field of Search ..... 128/477, 487, 516, 476, 128/455, 425

[56] References Cited

U.S. PATENT DOCUMENTS 2,899,961 8/1959 Faron ..... 128/516

3,062,216 11/1962 Stein ..... 128/467

3,699,971 10/1972 Hittel et al. ..... 128/491

*Primary Examiner*—Doris L. Troutman

*Attorney, Agent, or Firm*—Peter L. Berger

[57] ABSTRACT

An athletic support brassiere is disclosed which is comprised of cotton non-stretch strap members adjusted with a slide mechanism, a pair of cup members divided into upper and lower sections, with the upper and lower sections each being formed of a polyester cotton blend. Such a brassiere also includes a mesh formed along the inner edges of the brassiere to permit free flow of air during normal athletic use will prevent moisture build-up.

10 Claims, 4 Drawing Figures

FIG. 1
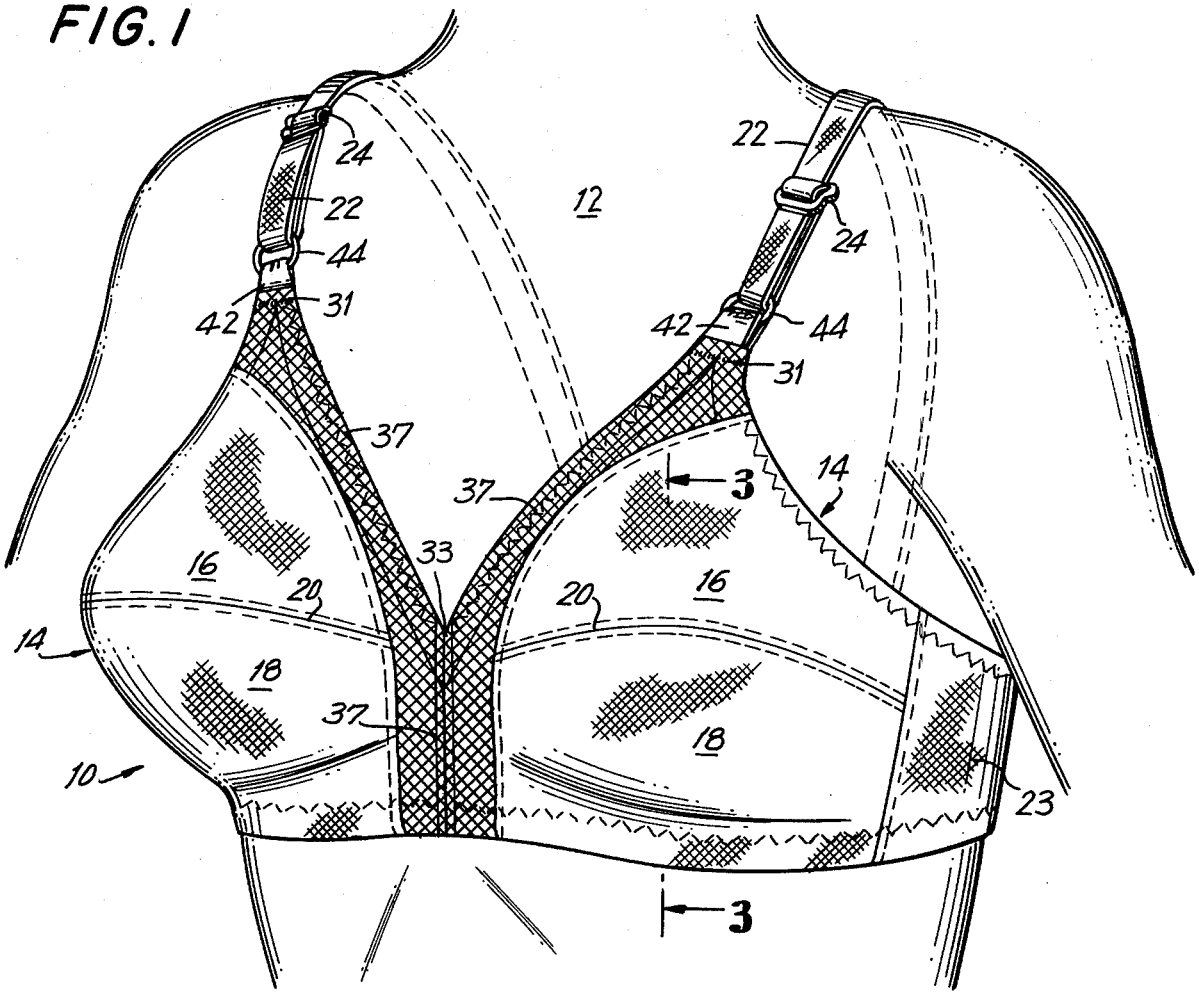
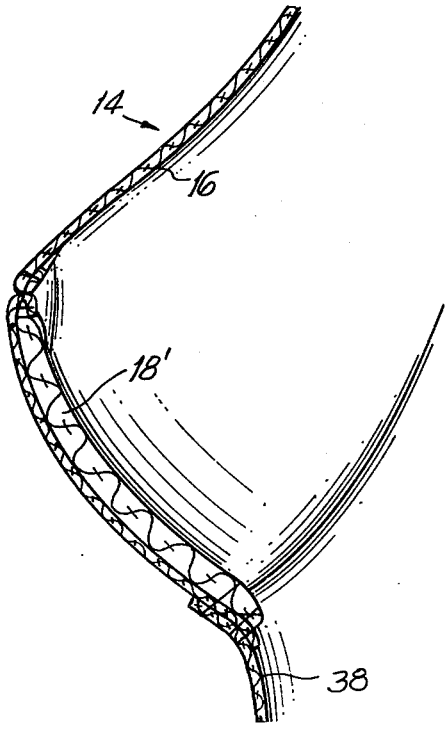
FIG. 4

ATHLETIC SUPPORT BRASSIERE

BACKGROUND OF THE INVENTION

This invention relates to a woman's brassiere, and more particularly, to a woman's brassiere designed especially for athletic wear.

Recently there has been an enormous increase in women engaging in athletic activities. As a consequence, numerous attempts have been made to produce athletic brassieres which would allow comfortable wear by the user, yet provide adequate support during the athletic activities.

One of the more popular athletic brassieres includes cups formed of elastic materials, and the cups force the woman's breasts flat against her body. Such a design is adequate for women who have relatively small breasts, but for women with larger breasts, such a design is uncomfortable and undesirable.

Two relatively popular athletic bras manufactured by Formit Rogers and Lily of France also are widely used as athletic bras. These bras are generally undesirable, because of several failings. In particular, there is insufficient support for the breasts during athletic activity. Additionally, the straps used to support the brassiere are either of elastic material which easily slip off the shoulder during such use or include a hook member which easily becomes disassembled. Further, such elastic straps detract from support and further counteracts such support. Still further, prior bra designs fail to provide for sufficient air passage in the areas where moisture builds up. This detracts from comfortable wear. The strap is connected to the cup with an elastic corner provided at the cup. Such elastic corner also lessens support for the wearer. The straps of prior bras rest generally in the shoulder areas and during use slip off the shoulder. Some of these athletic bras include a reinforced bottom edge to provide support for the wearer, but none of the brassieres of which the inventor is aware presents a design in which there is adequate support for a woman who does not have small breasts. Still further, there is no provision for such a brassiere which is comfortable to wear, effective in use and which provides good support to significantly lessen the bounce the breasts experience during athletic activity.

An object of this invention is to provide an athletic brassiere which provides improved support and comfort for women who are not small breasted.

Still another object of this invention is to provide such a brassiere which will find widespread use, be susceptible of easy manufacture, yet be comfortable.

Another object of this invention is to provide such a brassiere in which the strap does not easily become dislodged from the shoulder of the wearer nor counteract the support function.

Yet another object of this invention is to provide such a brassiere in which the strap adjustment mechanism is located in front of the body and does not become dislodged or unhooked during conventional usage.

Another object of this invention is to provide such a brassiere which will allow air flow through a portion of the brassiere cup to minimize moisture build up during athletic activity.

Other objects, advantages and features of this invention will become more apparent from the following description.

SUMMARY OF THE INVENTION

In accordance with the principles of this invention, the above objects are accomplished by providing an athletic support brassiere which comprises a pair of cup members, the cup members being divided into upper and lower half segments separated by a horizontal seam. The cup members are formed of a cotton polyester blend, and the lower segment is formed of the same material but may have a reinforced elastic having a thickness greater than that of the upper portion. The lower portion of each cup member provides a good support for the wearer, yet use of polyester cotton blend enhances the absorption of the moisture developed during athletic activity and minimizes wearer discomfort.

Another aspect of this invention is to provide cotton, non-elastic straps which are adjusted with a slide mechanism located in front of the body, such that the straps do not come off the shoulder of the wearer, nor does the slide mechanism become dislodged during normal activity. The straps add to the support function of the bra. Further, the straps are located closer to the neck of the wearer and pass on the medial side of the scapula angled inwardly toward the center of the back.

As another feature of this invention, the inner border region of each cup comprises a mesh. Such a mesh construction allows aeration through that portion of the brassiere which reduces moisture build-up.

Another feature of the present invention is to provide a reinforced bottom support along the underside edge of the lower portion of the brassiere which stretches across the front of the wearer. The reinforced cotton support is extended to each cup and upwardly along the inner edge of each cup to approximately the horizontal seam therein. The present invention provides a unique athletic brassiere which is capable of being comfortably worn, effectively utilized and well suited for women who are not small breasted.

BRIEF DESCRIPTION OF THE DRAWINGS

FIG. 1 is a perspective front view of the athletic support brassiere of this invention on the wearer.

FIG. 4 is a sectional view similar to FIG. 3 showing another embodiment of this invention.

DETAILED DESCRIPTION

Figure 2:
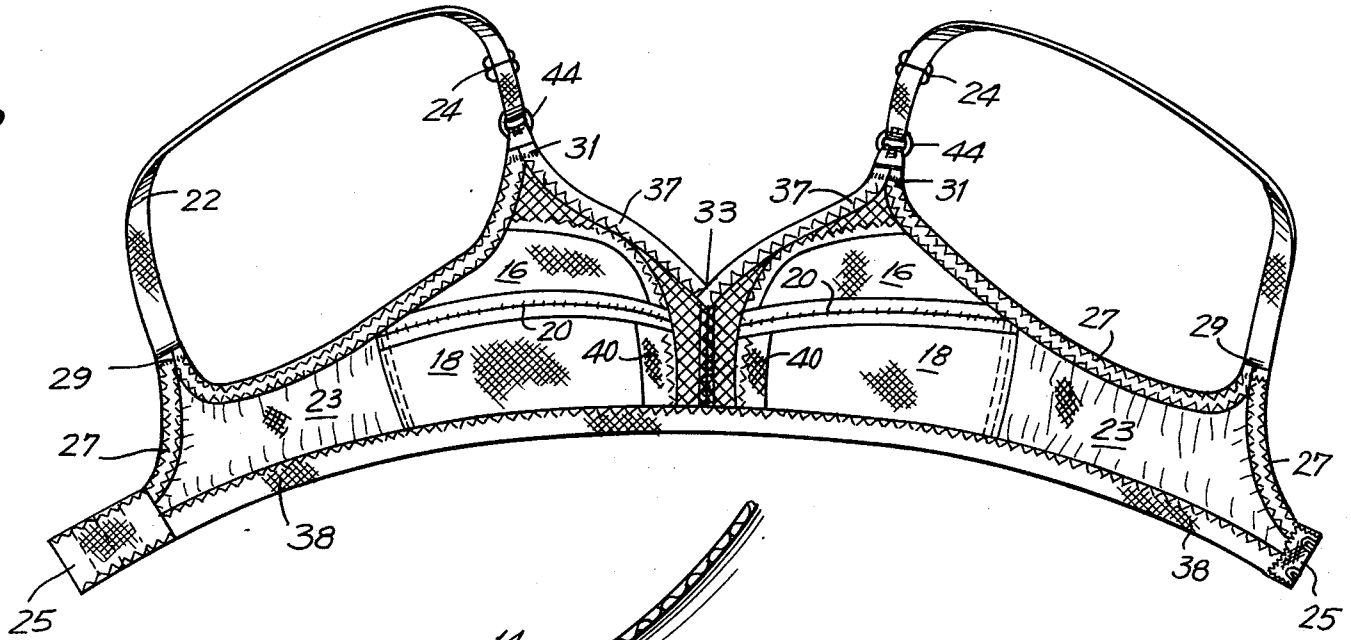
FIG. 2 is a rear view of the brassiere showing the inside surfaces of the brassiere.
Figure 3:
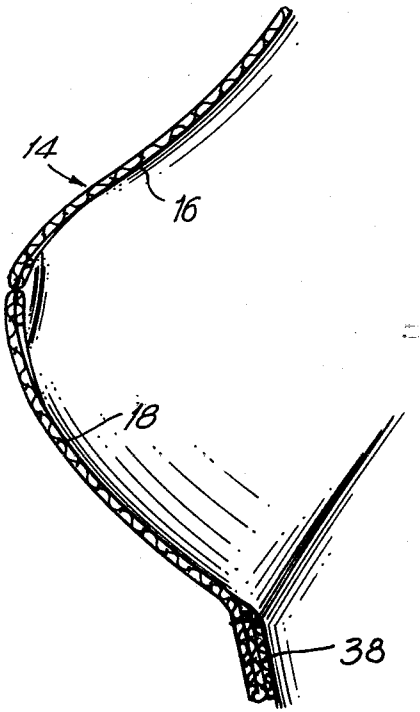
FIG. 3 is a sectional view taken along lines 3—3 of FIG. 1.

FIG. 1 shows the brassiere 10 on a wearer 12. The brassiere comprises a pair of cups 14, each cup comprising an upper section 16 and a lower section 18 separated by a horizontal seam 20. A pair of straps 22 are connected to hold the brassiere in place, and a pair of slides 24 slidable on each of said straps 22 adjusts the straps to the wearer's comfort.

Each cup is formed of a polyester cotton blend which is a cushioned elastic material. Use of the cushioned elastic support for the bottom portion 18 of cup 14 provides good support for the wearer during athletic use. Use of a polyester cotton for the cup enhances absorbability and minimizes friction and wear on the part of the user. The straps 22 each comprise non-elastic cotton which help the straps to stay in place and absorb moisture during athletic activity.

As a feature of this invention, the straps 22 are moved inwardly closer to the neck of the wearer. Additionally, the straps pass on the medial side of the scapula angled inwardly toward the center of the back (FIG. 2). Each cup 14 is connected at its outer edge to a side-back panel 23. Each panel 23 extends inwardly from the hook portion 25 along an upper border 27 which extends upwardly to an apex 29 and downwardly and laterally from said apex to form the upper edge of the panel 23 and upper outer side edge of the cup. Such border continues until the front apex 31 which is the front point at which the strap is connected to cup. The inward connection apex point 29 at the back of the wearer has two support edges formed by the side edges 27 which form the apex 29. This inward connection toward the center of the back helps to maintain the strap is place and inwardly toward the neck of the wearer.

Slide 24 carried on each strap will be fixedly held in place, and the prior art separate hook and eye members have been eliminated. Elimination of such hook and eye member eliminates the slippage occurring between the prior art straps during normal athletic activity.

As a further feature of this invention, a mesh 37 border is formed beginning at about the central separation between the cups 14 extending upwardly to the apex 31 of each cup. As may be readily understood, mesh 37 allows for free flow of air through that portion of the brassiere, further providing for comfort to the wearer and reduction in moisture build-up along the inner segment of the brassiere cups.

Each strap 22 is attached at the apex 31 to the cup 14. The apex region 31 comprises the mesh material 37 which is substantially non-stretchable attached to a small strip 42 to which a loop 44 is attached. Strap 22 is connected to said loop 44. The non-stretchable nature of mesh 37 reduces stretch in that region of the cup and increases support as compared with prior art construction.

As yet a further feature of this invention, the inner lower edge 38 of the brassiere is formed of a reinforced strip of cotton cushioning material to further provide support to the wearer. An additional strip 40 may be placed along the inside inner edges of each cup joining each other and the front lower portion of each cup.

FIG. 4 is another embodiment of this invention in which the lower section 18' of each cup comprises a double thick reinforced elastic support material for added comfort and support to the wearer.

The present invention provides unique support and comfort to the athletic woman. Other modifications and changes from this invention will be apparent to those of ordinary skill in the art, and the embodiment described in the specification is but illustrative of the invention.

What is claimed is:

1. An athletic support brassiere comprising a pair of strap members, a pair of cup members each having a front apex to which said strap members are attached for supporting said cup members on the shoulders of wearers, a bottom reinforced inner edge strip located at the bottom of said cup members and stretching across the front of the wearer, said cups each being formed of a polyester cotton blend and comprising an upper half section and a lower half section separated by a horizontal seam, and each of said cups comprising an open uncovered mesh region located along the inner edges of each said cups and extending toward the middle of said cups, said open uncovered mesh region extending to the bottom edge of said brassiere, said open uncovered mesh region being of such area with respect to each cup to permit air flow through the mesh region to aerate the breast of the wearer to reduce moisture build-up.

2. An athletic support brassiere as claimed in claim 1, whereas said strap members comprise a non-stretch material.

3. An athletic support brassiere as claimed in claim 2, further comprising an adjustable slide mechanism located on each of said strap members for adjusting the tension in said strap members.

4. An athletic support brassiere as claimed in claims 1, 2 or 3, wherein said bottom reinforced edge comprises a strip of cotton material attached to the underside surface of said lower edge of said brassiere.

5. An athletic support brassiere as claimed in claim 4, wherein each front half of said brassiere comprises a reinforcing strip extending upwardly located adjacent to the mesh from said bottom reinforced edge to the location of said horizontal seam in each of said cups.

6. An athletic support brassiere as claimed in claim 1, wherein said strap passes on the medial side of the scapula angled inwardly toward the center of the back.

7. An athletic support brassiere as claimed in claim 1, wherein each strap is connected to a respective hook, each cup being connected to a respective strip at said front apex, said strap being connected to said respective hook, said mesh comprising substantially non-stretch material.

8. An athletic support brassiere as claimed in claim 1, wherein each strap is worn inwardly towards the neck of the wearer.

9. An athletic support brassiere as claimed in claim 1, wherein the lower section of each cup has a thickness greater than that of the respective upper section.

10. An athletic support brassiere as claimed in claim 3, wherein said adjustable slide mechanism is located in front of the body of the wearer.

* * * * *